US005091712A

United States Patent [19]

Suuronen

[11] Patent Number: 5,091,712

[45] Date of Patent: Feb. 25, 1992

[54] THIN FILM FUSIBLE ELEMENT

[75] Inventor: David E. Suuronen, Newburyport, Mass.

[73] Assignee: Gould Inc., Eastlake, Ohio

[21] Appl. No.: 673,190

[22] Filed: Mar. 21, 1991

[51] Int. Cl.[5] ..... H01H 85/04

[52] U.S. Cl. ..... 337/297; 337/159; 337/295

[58] Field of Search ..... 337/159, 158, 295, 296, 337/297

[56] References Cited

U.S. PATENT DOCUMENTS

| | | | |
|---|---|---|---|
| 2,563,536 | 8/1951 | Laing . | |
| 3,271,544 | 9/1966 | Ragan . | |
| 3,287,526 | 11/1966 | Brandt . | |
| 3,868,619 | 2/1975 | Blewitt | 337/295 |
| 4,140,988 | 2/1979 | Oakes | 337/279 |
| 4,208,645 | 6/1980 | Harmon et al. | 337/297 |
| 4,376,927 | 3/1983 | McGalliard | 337/297 |
| 4,434,548 | 3/1984 | Beswick | 29/623 |
| 4,494,104 | 1/1985 | Holmes | 337/403 |
| 4,520,338 | 5/1985 | Watanabe | 337/297 |
| 4,689,598 | 8/1987 | Ishikawa et al. | 337/159 |
| 4,749,980 | 6/1988 | Morrill, Jr. et al. | 337/232 |
| 4,871,990 | 10/1989 | Ikeda et al. | 337/238 |
| 4,873,506 | 10/1989 | Gurevich | 337/290 |

*Primary Examiner*—Harold Broome
*Attorney, Agent, or Firm*—Fish & Richardson

[57] ABSTRACT

A fusible element component for use in an electrical fuse, the element including a substrate made of insulative material and having an element supporting surface, a fusible element made of a thin film of conductive material on the element supporting surface, the element having a body portion for conducting electricity therethrough from and to an external electrical circuit, the body portion having back-up sections and a fusible portion that is designed to fuse during electrical overload conditions, and cooling arms that are made of the thin film of conductive material and extend laterally from the back-up sections to conduct and dissipate heat but not conduct electricity.

8 Claims, 1 Drawing Sheet

THIN FILM FUSIBLE ELEMENT

BACKGROUND OF THE INVENTION

The invention relates to thin film fusible elements that are supported on substrates and electrical fuses employing them.

It is known to provide fusible elements from thin films of conductive material supported on insulating substrates. This permits an element thickness that is less than that achievable by stamping (i.e., 0.002") in order to provide low-current capacity and ease of handling at low-current capacity. Examples of patents describing fusible elements having thin films of conductive material on substrates provided by various deposition techniques are: U.S. Pat. Nos. 3,271,544; 4,140,988; 4,208,645; 4,376,927; 4,494,104; 4,520,338; 4,749,980; and 4,873,506.

SUMMARY OF THE INVENTION

In general, the invention features a thin film fusible element that is supported on an insulating substrate and has a body portion for conducting electricity therethrough and cooling arms that extend laterally from a side of the body portion. The body portion has back-up sections and a fusible portion of narrower conductive area than back-up sections. The cooling arms conduct and dissipate heat but do not conduct electricity. The cooling arms facilitate the removal of heat from a fusible portion of the body portion, thus regulating the fusible portion temperature and melting characteristics.

In preferred embodiments, the body portion has a plurality of alternating back-up sections and fusible portions. In some embodiments, the cooling arms extend generally perpendicular to a longitudinal body axis along the body portion; in some other embodiments, the cooling arms make acute angles with the body axis, and in some other embodiments the cooling arms have segments that extend first in one direction generally parallel to the body axis and then the other direction generally parallel to the body axis.

The fusible element is preferably used in a fuse in a fuse casing having arc-quenching fill material therein. The cooling arms better distribute the heat throughout the fill material because the arms project into more regions of the fill material than the body portion alone. A thermally conductive paste can be placed on the arms to enhance the removal of the heat from the arms to the arc-quenching fill material.

Other features and advantages of the invention will be apparent from the following description of the preferred embodiments thereof and from the claims.

DESCRIPTION OF THE PREFERRED EMBODIMENTS

The preferred embodiments will now be described.

DRAWINGS

STRUCTURE

Figure 1:
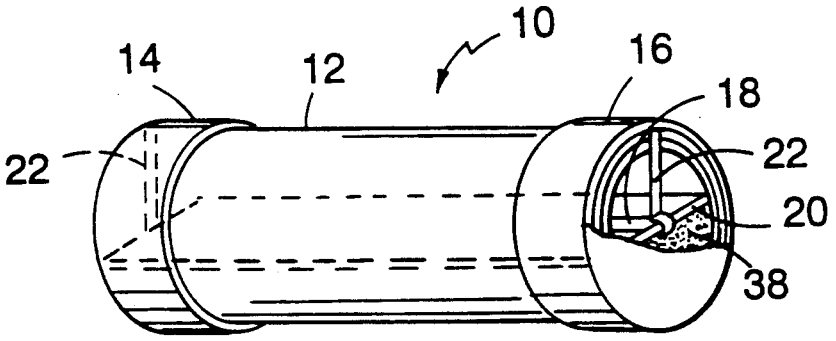
FIG. 1 is perspective view, partially broken away, of a fuse including a thin film fusible element according to the invention.

Referring to FIG. 1, there is shown electrical fuse 10 having fuse casing 12, end cap terminals 14, 16, and fusible element 18 supported on ceramic substrate 20 within casing 12. Metal strip 22 is soldered to fusible element 18 and metal end cap terminal 16 and makes electrical contact between them.

Figure 2:
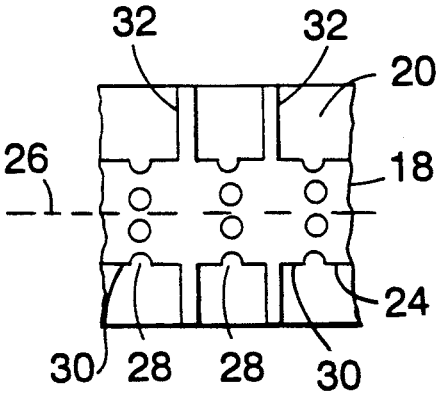
FIGS. 2–4 are a partial plan views showing different geometries that can be employed for the fusible element used in the FIG. 1 fuse.
Figure 3:
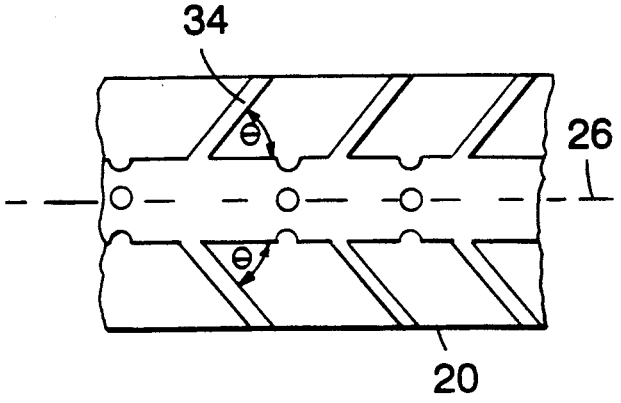
Figure 4:
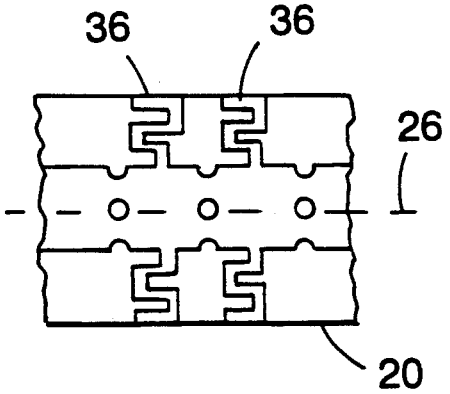

Referring to FIG. 2, it is seen that fusible element 18 has body portion 24 that extends along longitudinal body axis 26. Body portion 24 has fusible portions 28 (also referred to as notch regions) and back-up sections 30 of larger width therebetween. Extending laterally from back-up sections 30 are cooling arms 32. The body portions and cooling arms are preferably made of copper deposited thereon by D.C. magnetron sputtering. The thickness of copper depends upon the fuse rating; a one amp fuse would have copper approximately 70 microinches thick. In the FIG. 2 embodiment, cooling arms 32 extend perpendicular to body axis 26. In the embodiment shown in FIG. 3, cooling arms 34 make an acute angle $\theta$ with body axis 26. In the embodiment shown in FIG. 4, cooling arms 36 follow a zig-zag pattern and have segments that extend generally parallel to axis 26 first in one direction, then the other. Conductive paste is placed on arms 32, 34, 36 to conduct heat to arc-quenching fill material 38 (e.g., 50/70 quartz). The paste substantially fills all voids adjacent to the cooling fins. (The fill material, shown only partially filling casing 12 in FIG. 1, in fact fills the entire casing.) Conductive paste generally is not placed on body portion 24 so as to not interfere with circuit breaking characteristics of body portion 24 during overload conditions.

OPERATION

In operation, electrical current is conducted from and to an external electrical circuit via end cap terminals 14, 16 and metal strips 22 to fusible element 18. During normal current load conditions, current flows through body portion 24; current density is not significantly affected by the existence of cooling arms 32, 34, or 36, because there are no electrical paths through them. The temperature of the cooling arms is less than that of back-up sections 30, which are at lower temperature than fusible portions 28. Heat flows to the cooling arms and is dissipated to the arc-quenching fill material, the arms permitting good distribution of heat. The removal of heat influences the melt time characteristics of the particular fusible portions 28, allowing for a thinner fuse element material and reduced Joule heating. At overload circuit conditions, fusible portions 28 melt, creating an open circuit.

OTHER EMBODIMENTS

Other embodiments of the invention are within the scope of the claims.

What is claimed is:

1. A fusible element component for use in an electrical fuse, said component comprising an elongated substrate made of insulative material and having an element supporting surface, said substrate having lateral edges and a longitudinal axis, a fusible element made of a thin film of conductive material on said element supporting surface, said element extending parallel to the longitudinal axis of said substrate spaced from the lateral edges thereof, said element having a body portion for conducting electricity therethrough from and to an external electrical circuit, said body portion being elongated, extending along said longitudinal axis, and having back-up sections and a fusible portion that has smaller conductive area than said back-up sections and is designed to fuse during electrical overload conditions, and cooling arms that are made of said thin film of conductive material on said substrate and extend laterally from said back-up sections to conduct and dissipate heat but not conduct electricity.

2. The component of claim 1 wherein said body portion has a plurality of said fusible portions between back-up sections.

3. The component of claim 2 wherein said cooling arms extend generally perpendicular to said longitudinal axis.

4. The component of claim 2 wherein said body portion is elongated and extends along a longitudinal body axis, and said cooling arms make an acute angle with said body axis.

5. The component of claim 2 wherein said body portion is elongated and extends along a longitudinal body axis, and said cooling arms have portions that extend in one direction generally parallel to said body axis and then the other direction generally parallel to said body axis.

6. A fuse comprising a fuse casing, two terminals on said casing for providing external electrical connection, and a fusible element component in said casing, said component comprising an elongated substrate made of insulative material and having an element supporting surface, said substrate having lateral edges and a longitudinal axis, a fusible element made of a thin film of conductive material on said element supporting surface, said element extending parallel to the longitudinal axis of said substrate spaced from the lateral edges thereof, said element having a body portion for conducting electricity therethrough from and to an external electrical circuit, said body portion being elongated, extending along said longitudinal axis, and having back-up sections and a fusible portion that has a smaller conductive area than aid back-up sections and is designed to fuse during electrical overload conditions, and cooling arms that are made of said thin film of conductive material on said substrate and extend laterally from said back-up sections to conduct and dissipate heat but not conduct electricity.

7. The fuse of claim 6 further comprising arc-quenching fill material in said casing between said substrate and casing.

8. A fuse comprising a fuse casing, two terminals on said casing for providing external electrical connection, and a fusible element component in said casing, said component comprising a substrate made of insulative material and having an element supporting surface, a fusible element made of a thin film of conductive material on said element supporting surface, said element having a body portion for conducting electricity therethrough from and to an external electrical circuit, said body portion having back-up sections and a fusible portion that has a smaller conductive area than said back-up sections and is designed to fuse during electrical overload conditions, and cooling arms that are made of said thin film of conductive material on said substrate and extend laterally from said back-up sections to conduct and dissipate heat but not conduct electricity, further comprising arc-quenching fill material in said casing between said substrate and casing, further comprising heat-conducting paste on the surfaces of said cooling arms and in heat-conducting relationship with said arc-quenching fill material.

* * * * *